US008408663B2

(12) United States Patent
Chellappan et al.

(10) Patent No.: US 8,408,663 B2
(45) Date of Patent: Apr. 2, 2013

(54) CONSUMER APPLIANCE DRAWER WITH IMPROVED ANTI-RACKING SYSTEM

(75) Inventors: Bagawathkumar Chellappan, Louisville, KY (US); James Bryan Rawson, Crestwood, KY (US); Manivannan Loganathan, Hyderabad (IN)

(73) Assignee: General Electric Company, Schenectady, NY (US)

( * ) Notice: Subject to any disclaimer, the term of this patent is extended or adjusted under 35 U.S.C. 154(b) by 246 days.

(21) Appl. No.: 12/951,297

(22) Filed: Nov. 22, 2010

(65) Prior Publication Data

US 2012/0125035 A1 May 24, 2012

(51) Int. Cl.
*A47B 96/02* (2006.01)
*F25D 25/02* (2006.01)

(52) U.S. Cl. ..... 312/402; 312/331; 62/382; 62/465

(58) Field of Classification Search ..... 312/402, 312/404, 319.5–319.8, 331; 62/382, 465
See application file for complete search history.

(56) References Cited

U.S. PATENT DOCUMENTS

| | | | | |
|---|---|---|---|---|
| 4,324,439 | A * | 4/1982 | Hagen et al. | 384/18 |
| 5,040,856 | A | 8/1991 | Wilkins et al. | |
| 5,366,284 | A | 11/1994 | Baker et al. | |
| 2004/0035129 | A1* | 2/2004 | Kaiser | 62/302 |
| 2005/0160854 | A1* | 7/2005 | Rotter | 74/422 |
| 2007/0144408 | A1* | 6/2007 | Rotter | 108/16 |
| 2007/0245762 | A1* | 10/2007 | Maglinger et al. | 62/344 |
| 2008/0314067 | A1* | 12/2008 | Lee | 62/441 |
| 2008/0315739 | A1* | 12/2008 | Hirano | 312/330.1 |
| 2009/0026906 | A1* | 1/2009 | Kim | 312/401 |
| 2009/0045713 | A1* | 2/2009 | Kunkle et al. | 312/402 |
| 2009/0167130 | A1* | 7/2009 | Chellappan et al. | 312/402 |
| 2009/0243448 | A1* | 10/2009 | Yu et al. | 312/319.5 |
| 2009/0261698 | A1* | 10/2009 | Cabal Velarde et al. | 312/334.8 |
| 2009/0288428 | A1* | 11/2009 | Kopf | 62/66 |
| 2009/0302728 | A1* | 12/2009 | Rotter et al. | 312/404 |
| 2009/0322196 | A1* | 12/2009 | Park | 312/404 |
| 2010/0007256 | A1* | 1/2010 | Kim et al. | 312/408 |
| 2010/0219727 | A1* | 9/2010 | Aguilar Ante et al. | 312/319.1 |
| 2011/0006656 | A1* | 1/2011 | Nam et al. | 312/404 |
| 2011/0050065 | A1* | 3/2011 | Lee et al. | 312/402 |
| 2011/0089795 | A1* | 4/2011 | Yoon | 312/319.7 |
| 2011/0210655 | A1* | 9/2011 | Brown et al. | 312/334.8 |
| 2012/0091872 | A1* | 4/2012 | Matthes et al. | 312/334.8 |

* cited by examiner

*Primary Examiner* — James O Hansen
*Assistant Examiner* — Ryan A Doyle
(74) *Attorney, Agent, or Firm* — Dority & Manning, P.A.

(57) ABSTRACT

A consumer appliance, for example a refrigeration appliance, includes a compartment with a pull-out drawer. A slide member is configured on each opposite side of the compartment, with the drawer having a slide bracket mounted to each respective slide member for movement of pull-out drawer into and out of the compartment. A gear rail is configured on each opposite side of the compartment adjacent to the slide member. A gear assembly is mounted to each slide bracket and includes a first gear engaged with the gear rail and a pinion gear engaged with the first gear. The pinion gear has a rotational axis that is vertically displaced from the rotational axis of the first gear. A cross bar is connected between the pinion gears.

17 Claims, 4 Drawing Sheets

CONSUMER APPLIANCE DRAWER WITH IMPROVED ANTI-RACKING SYSTEM

FIELD OF THE INVENTION

The present subject matter relates generally to pull-out drawers and more particularly to an anti-racking system for consumer appliance drawers.

BACKGROUND OF THE INVENTION

Various types of consumer appliances are designed with pull-out compartment drawers. For example, a number of popular refrigerator styles have freezer compartments with one or more pull-out drawers that span the width of the appliance and include storage baskets or bins. Examples of these refrigerators include the Profile™ French door and Armoire style refrigerators from General Electric Appliances. The conventional pull-out drawers typically include side brackets that are mounted to slides of a slide mechanism that, in turn, has a base member mounted to the compartment liner.

Due to their substantial width, depth, and weight, the pull-out drawers are susceptible to misalignment between the sides when moving the drawer into and out of the appliance compartment, particularly if the door is grasped off-center and the pulling/closing force is applied non-parallel to the slide structure. This misalignment may lead to binding or "racking" of the drawer, which may make further movement of the drawer difficult and may also lead to an improper seal of the drawer in the closed position.

A known approach to minimize racking of the drawers is to synchronize the sliding movement of the opposite slide mechanisms with a gear and cross shaft assembly. A gear is provided at each side of the drawer that engages with a stationary gear rail as the drawer moves in and out of the freezer compartment. The gears are connected with a cross shaft that spans the width of the drawer. The shaft synchronizes movement of the respective gears along the gear rail, which is imparted to the slide mechanisms. Thus, any off-center pulling/pushing force on the drawer handle is compensated for through the shaft and gears.

Although the shaft and gear assembly discussed above is beneficial in minimizing the occurrence of racking, location of the shaft is problematic in that it reduces the usable volume of the compartment for features such as bins, baskets, ice buckets, and so forth, especially when such devices are suspended above or below the drawer in a freezer compartment.

Accordingly, it would be desirable to provide an anti-racking system for pull-out drawers that includes the benefits of the shaft and gear assembly discussed above without sacrificing usable volume of the compartment.

BRIEF DESCRIPTION OF THE INVENTION

Aspects and advantages of the invention will be set forth in part in the following description, or may be obvious from the description, or may be learned through practice of the invention.

In an exemplary embodiment, a consumer appliance, for example a refrigeration appliance, is provided with a compartment having a pull-out drawer. The appliance may be a refrigerator having a freezer compartment with one or more pull-out drawers. The pull-out drawer includes a slide bracket mounted to respective slide members configured on each opposite side of the compartment for movement of the pull-out drawer into and out of the compartment. A gear rail is configured on each opposite side of the compartment generally adjacent to the slide member. A gear assembly is mounted for movement with each slide bracket, with each gear assembly having a first gear engaged with the gear rail and a pinion gear engaged with the first gear. The pinion gear has a rotational axis that is vertically displaced from a rotational axis of the first gear. A cross bar is connected between opposite pinion gears. In this manner, a driving force generated at one gear assembly from an off-center pulling force on the drawer is transmitted through the cross bar to the opposite gear assembly.

In still a further embodiment in accordance with aspects of the invention, a refrigeration appliance is provided with a freezer compartment having an upper pull-out drawer and a lower pull-out drawer. The lower pull-out drawer includes a slide member configured on each opposite side of the freezer compartment and the pull-out drawer includes a slide bracket mounted to each respective slide member for movement of the pull-out drawer into and out of the freezer compartment. A gear rail is configured on each opposite side of the freezer compartment generally adjacent to the slide members. A gear assembly is mounted for movement with each slide bracket, with each gear assembly having a first gear engaged with the gear rail and a pinion gear engaged with the first gear. The pinion gear has a rotational axis that is vertically displaced from a rotational axis of the first gear, with a cross bar connected between the pinion gears. In this manner, a driving force generated at one gear assembly from an off-center pulling force on the lower pull-out drawer is transmitted through the cross bar to the opposite gear assembly. The vertical displacement of the pinion gears and cross bar provides for more efficient use of the compartment space. For example, in a particular embodiment, an ice bucket is disposed in the lower pull-out drawer to receive ice from an icemaker in the upper pull-out drawer. Location of the cross bar permits the ice bucket to have a depth within the lower pull-out drawer so as to extend above and rearward of the crossbar.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
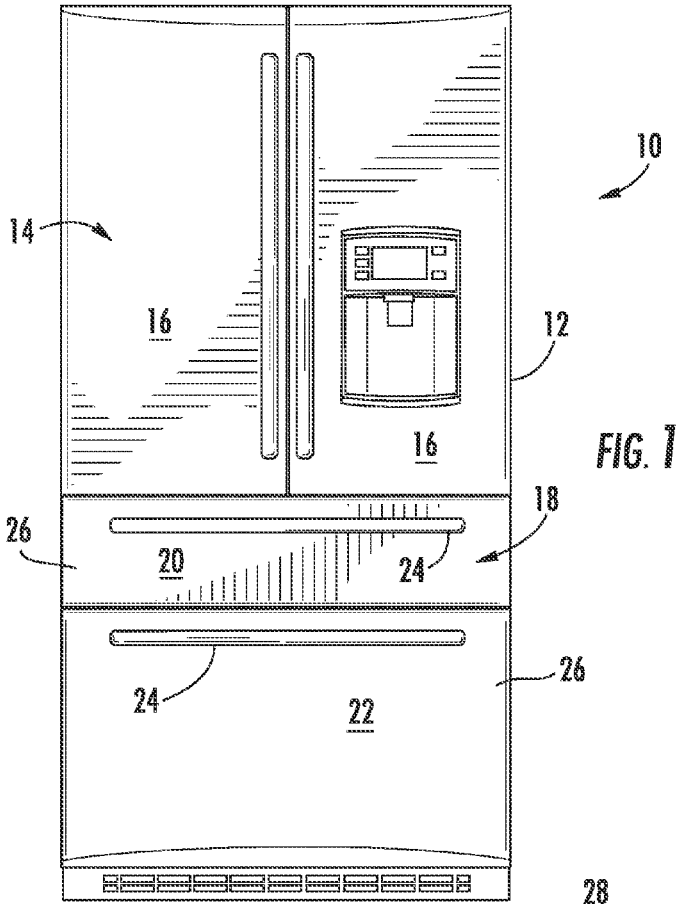
FIG. 1 is a perspective view of a consumer appliance, in particular a refrigeration appliance, that may incorporate aspects of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 depicts a consumer appliance 10 in a form of a refrigerator that may incorporate one or more pull-out drawers in accordance with aspects of the invention. It should be appreciated that the term "consumer appliance" is used in a generic sense herein to encompass any manner of household appliance having an internal storage compartment that is accessible via a pull-out drawer. Conventional consumer appliances include, for example, refrigerators, freezers, ovens, washing machines, dryers, ranges, and so forth. For illustrative purposes, the present invention is described herein as a refrigerator embodiment of a consumer appliance 10. In this regard, the terms "refrigerator" or "refrigeration appliance" are also used in a generic sense herein to encompass any manner of refrigeration appliance, such as a freezer, refrigerator/freezer combination, and any style or model of conventional refrigerator. In the illustrated embodiment, the refrigerator 10 is depicted as an upright refrigerator having a cabinet or casing 12 that defines a number of internal storage compartments. In particular, the refrigerator 10 includes upper fresh-food compartments 14 having doors 16 and lower freezer compartment 18 having upper drawer 20 and lower drawer 22. The drawers 20, 22 are "pull-out" drawers in that they can be manually moved into and out of the freezer compartment 18 on suitable slide mechanisms, as depicted in FIG. 2.

Although described herein with reference to pull-out freezer compartment drawers, it should be appreciated that drawers in accordance with aspects of the invention are not limited in this manner and may have utility within the fresh-food compartment 14, or in any other compartment of a consumer appliance.

Figure 2:
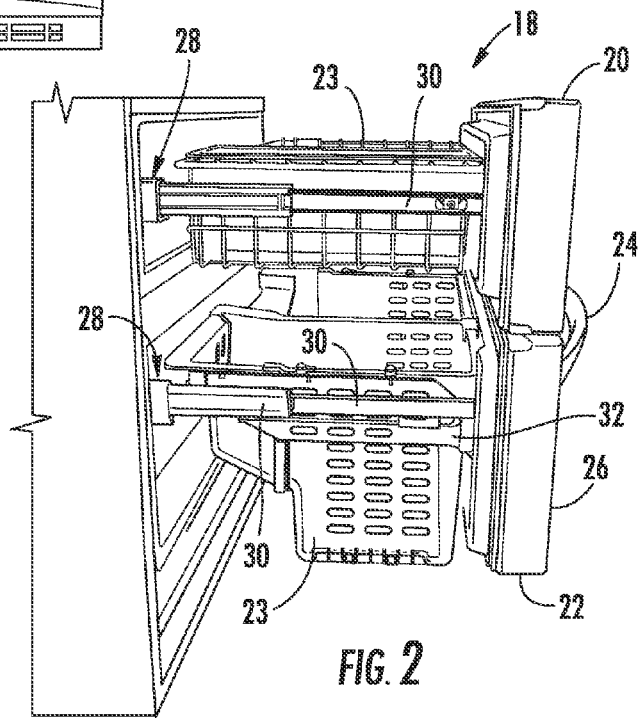
FIG. 2 is perspective view of the freezer compartment of the refrigerator of FIG. 1 with the pull-out drawers in the open position.

FIG. 2 depicts the freezer compartment 18 of the refrigerator 10 with the upper drawer 20 and the lower drawer 22 pulled out of the compartment. Each drawer 20, 22 may include any manner of storage basket or bin 23. Each of the drawers 20, 22 essentially spans the width of the compartment 18 and move into and out of the compartment via a respective slide assembly 28, which are widely used and known in the art and need not be described in detail herein. In general, the slide assembly 28 includes a base 29 (FIG. 6) that is mounted to each opposite side of the compartment 18 (for example on the liner sidewalls), and one or more slide members 30 that move linearly into and out of the base 29 via a suitable bearing arrangement. Multiple slide members 30 may telescope relative to each other. The drawers 20, 22 include slide brackets 32 that are mounted to the slide members 30.

Each drawer 20, 22 includes a handle 24 mounted to a front panel 26 whereby the drawer is moved into and out of the compartment 18 by a consumer grasping and pulling or pushing on the handle 24. As discussed above, an off-center pull/push force can result in racking of the drawer 20, 22 relative to the casing 12, particularly for the heavier lower drawer 22.

Figure 3:
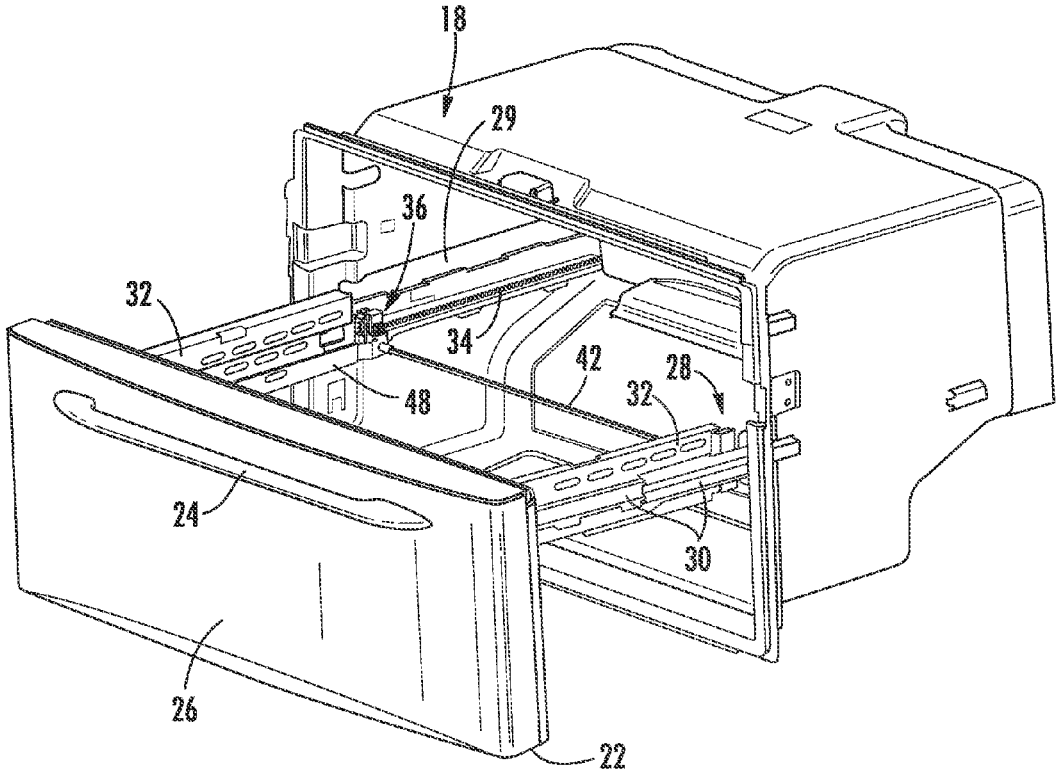
FIG. 3 is a partial perspective view of the lower pull-out drawer particularly illustrating location of the gear assemblies and cross bar.
Figure 4:
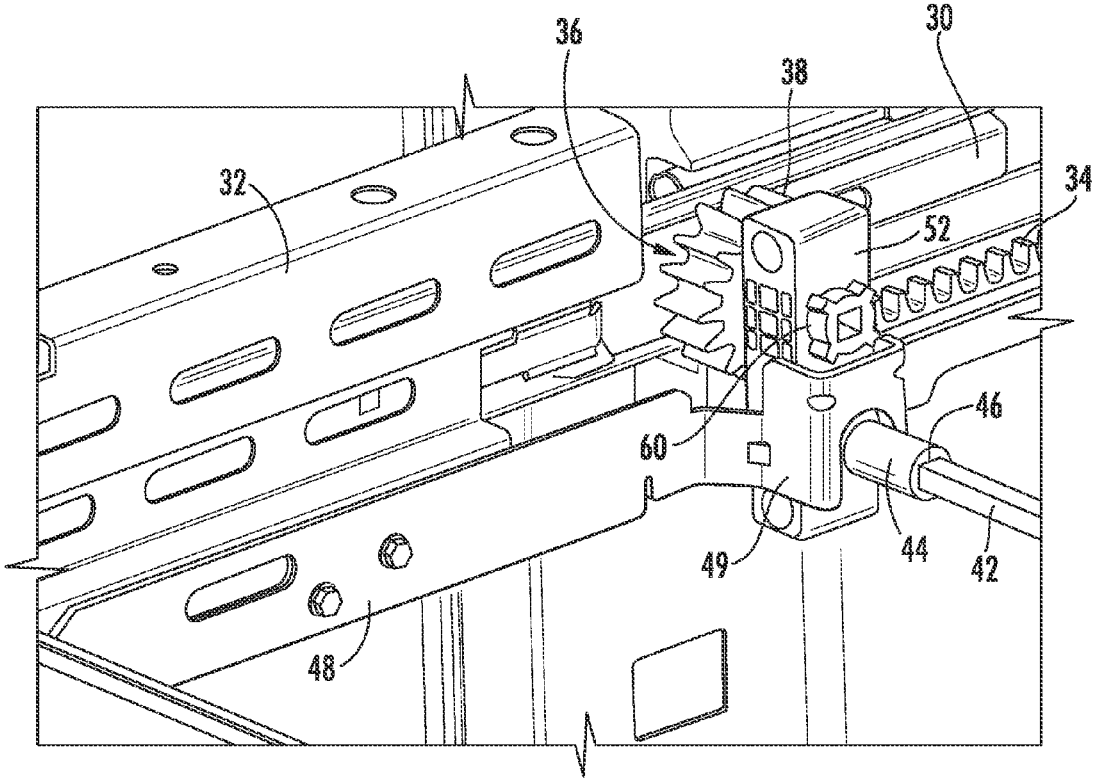
FIG. 4 is an enlarged perspective view of the gear assembly and slide bracket configuration of a particular embodiment.

Referring to FIGS. 3 and 4 in particular, an axially extending gear rail 34 is configured on each opposite side of the compartment 18 adjacent to the slide member 30. The gear rail 34 may be a component that is formed integral with the slide assembly base 29, or may be a separately formed component that is mounted under or on the base 29. The gear rail 34 includes an upper surface having gear teeth defined thereon, as can be particularly seen in FIG. 4.

Figure 5:
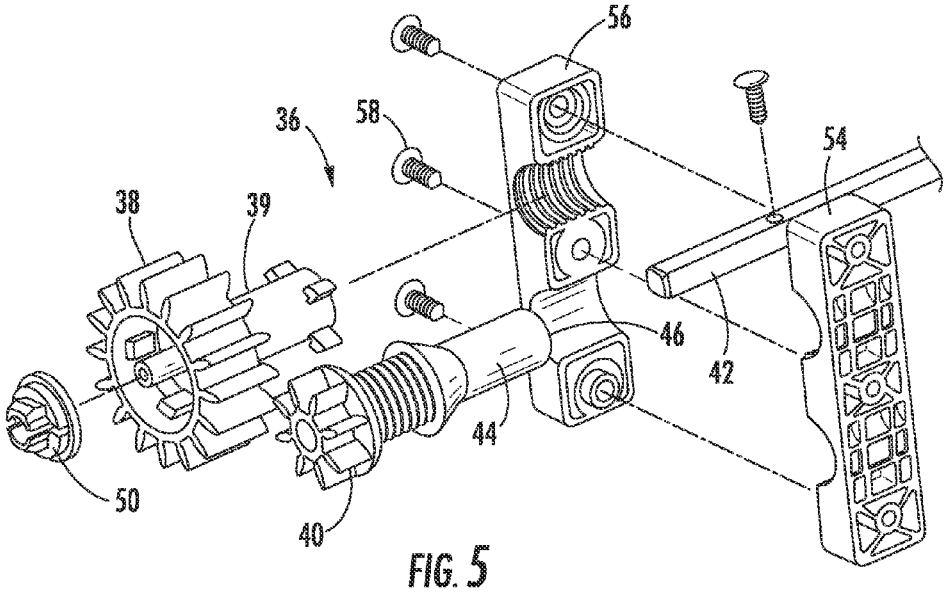
FIG. 5 is a component view of an embodiment of a gear assembly and cross bar configuration.

A gear assembly 36 is mounted to each of the slide brackets 32. The gear assembly 36 includes a first gear 38 that is geared engagement with the gear rail 34 so as to rotate as the front panel 26 (and attached slide brackets 32) of the drawer 22 is moved into and out of the compartment 18. Referring to FIG. 5, the gear assembly 36 includes a second or "pinion" gear 40 that is gearingly engaged with the first gear 38. The pinion gear 40 has a rotational axis that is vertically displaced from the rotational axis of the first gear 38, as can be particularly appreciated from the component view of FIG. 5. The pinion gear 40 is also horizontally offset relative to the first gear 38 so as not to rub or slide against the gear rail 34 with movement of the slide bracket 32.

A crossbar 42 is connected between the respective pinion gears 40. For example, in the embodiment illustrated in the figures, the crossbar 42 has a multi-sided cross-sectional profile that engages in a keyed hub 46 that is defined in an axial extension 44 of each pinion gear 40. With this particular configuration, a non-centered force that is generated at one of the gear assemblies 36 from an off-center pulling or pushing force on the drawer 22 is transmitted through the crossbar 42 to the opposite gear assembly 36 such that the imbalance is "equalized" and the likelihood of the drawer racking or binding in the compartment 18 is significantly reduced.

The slide brackets 32 may be attached to the inside of the drawer front panel 26 and are attached to the slide member or members 30 (directly or indirectly) by any suitable mechanical attachment, such as a snap fit, fasteners, rivets, and so forth. The gear assembly 36 is stationarily mounted relative to the slide bracket 32. In the illustrated embodiment, a bracket or brace 48 (FIG. 4) is mounted along the bottom of the slide bracket 32 and the gear assembly 36 is contained within a receiver portion 49 of the bracket 48. As described in more detail below, the gear assembly 36 may be snap-fitted into the receiver 49 for ease of assembly and disassembly. The gear assembly 36 may, in an alternate embodiment, be mounted or supported by a portion of the slide member 30 that is connected to the bracket 32 since the bracket 32 and respective slide members 30 are positionally fixed relative to each other. In the illustrated embodiment, the first gear 38 is also rotationally supported by the slide member 30 via a post 50 (FIG. 5) that engages within a hole or space in the portion of the slide member 30 opposite from the first gear 38. This configuration provides additional rotational support for the first gear 38 and serves to mechanically connect the gear assembly 36 to both the slide bracket 32 and slide member 30.

Referring to FIGS. 4 and 5, in a particular embodiment of the gear assembly 36, a vertically oriented connector housing 52 is provided. The first gear 38 and pinion gear 40 are rotationally supported within the housing 52. The housing 52 is, in turn, attached directly or indirectly to the slide brackets 32, as discussed above. In a unique embodiment, the housing 52 includes housing halves 54 and 56 that are joined together via fasteners 58 or any other suitable devices. The first gear 38 includes an axial extension 39 that is seated within the housing members 54, 56. Likewise, the pinion gear 40 includes an axial extension 44 that is seated within the housing members 54, 56. A retainer cap 60 (FIG. 4) secures the first gear 38 relative to the housing 52. Engagement of the crossbar 42 within the keyed hub 46 defined in the end face of the axial extension 44 ensures that the pinion gear 40 is securely held within the housing 52. Referring to FIG. 4, the housing 52 may have an overall shape and configuration so as to snap-fit into the receiver section 49 of the bracket 48.

Figure 6:
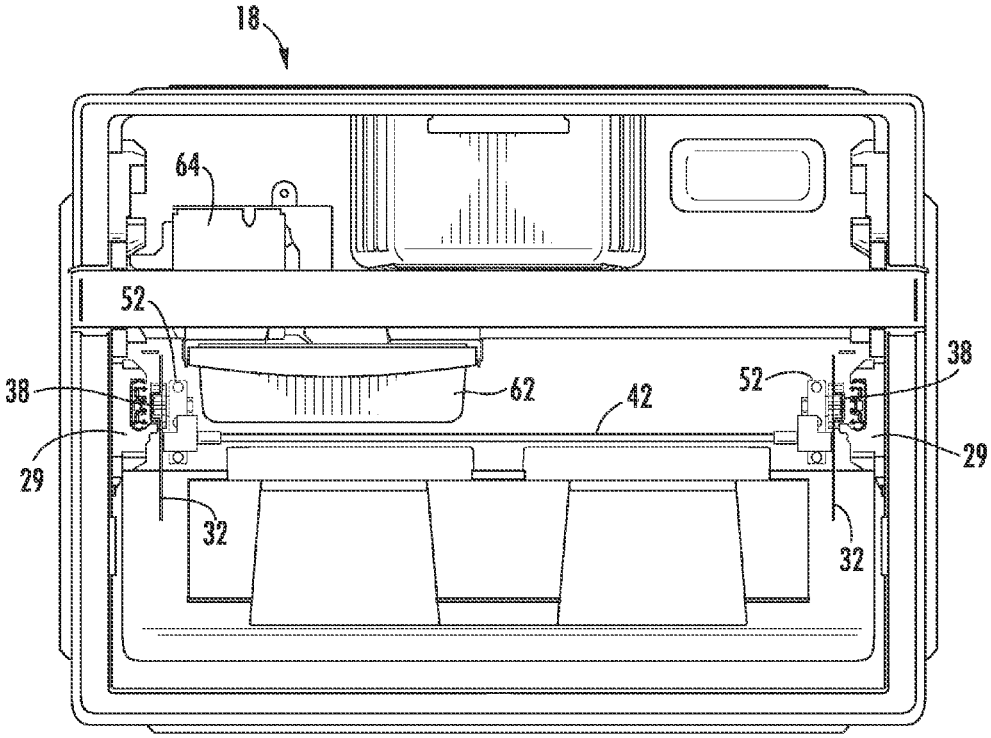
FIG. 6 is front view of the freezer compartment particularly illustrating relative position and location of the gear assemblies and cross bar with respect to other components within the freezer compartment.

FIG. 6 is a front view of the freezer compartment 18 with the front panel 26 removed and particularly illustrates the vertically offset position of the crossbar 42 relative to the rotational axis of the first gears 38. This vertical displacement of the crossbar 42 moves the bar below an ice bucket 62 mounted in the lower drawer below an ice maker 64. The ice bucket 62 has a depth within the lower drawer 22 so as to extend above and rearward of (i.e., beyond) the crossbar 42. By lowering the crossbar 42 relative to the slide assembly base 29, the depth of the ice bucket 62 can be increased, thereby making more efficient use of the limited volume within the freezer compartment 18. The drawer 22 can be moved into and out of the freezer compartment 18 without interference between the crossbar 42 and ice bucket 62.

While described and illustrated in the exemplary context of a refrigerator drawer, it should be appreciated that the drawer assemblies described herein are not necessarily limited to use in any particular type of refrigerator, and may also have utility in a wide variety of appliances or other products. All such uses are within the scope and spirit of the invention.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A consumer appliance, comprising:

a compartment with a pull-out drawer;

a slide member configured on each opposite side of said compartment, said pull-out drawer having a slide bracket mounted to each respective said slide member for movement of said pull-out drawer into and out of said compartment;

a gear rail configured on each opposite side of said compartment adjacent said slide member;

a gear assembly mounted to each said slide bracket, said gear assembly comprising a first gear engaged with said gear rail and a pinion gear engaged with said first gear, said pinion gear having a rotational axis that is vertically displaced below a rotational axis of said first gear and below said gear rail; and a cross bar connected between said pinion gears and aligned with said rotational axis of said pinion gears such that driving force generated at one said gear assembly from an off-center pulling force on said pull-out drawer is transmitted through said cross bar to the opposite said gear assembly.

2. The consumer appliance as in claim 1, wherein said pull-out drawer comprises a front panel, said slide brackets attached at opposite sides of said front panel, and further comprising a slide assembly mounted to each opposite side of said compartment, said slide members moveable linearly into and out of said slide assemblies, said slide brackets attached to said slide members, said gear assemblies mounted to at least one of said slide member or said slide bracket.

3. The consumer appliance as in claim 2, further comprising a bracket connecting said gear assembly to said slide bracket and a post connecting said first gear to said slide member.

4. The consumer appliance as in claim 2, wherein said gear rails are mounted below said slide assemblies.

5. The consumer appliance as in claim 1, wherein said gear assembly comprises a vertically oriented connector housing, said first gear and said pinion gear rotationally carried in said connector housing, said connector housings attached to said slide brackets.

6. The consumer appliance as in claim 5, further comprising a bracket mounted to each said slide bracket, said connector housing snap-fitted onto said bracket.

7. The consumer appliance as in claim 6, wherein said first gears are rotationally connected to said slide member with a concentric post.

8. The consumer appliance as in claim 1, wherein said pinion gears comprise a keyed hub, said cross bar having opposite ends that fit into said keyed hubs.

9. The consumer appliance as in claim 1, wherein said consumer appliance is a refrigeration appliance, said pull-out drawer configured in a freezer compartment of said refrigerator appliance.

10. A refrigeration appliance, comprising:

a freezer compartment with an upper pull-out drawer and a lower pull-out drawer;

said lower pull-out drawer further comprising a slide member configured on each opposite side of said freezer compartment, said pull-out drawer having a slide bracket mounted to each respective said slide member for movement of said pull-out drawer into and out of said freezer compartment;

a gear rail configured on each opposite side of said freezer compartment adjacent said slide member;

a gear assembly mounted to each said slide bracket, said gear assembly comprising a first gear engaged with said gear rail and a pinion gear engaged with said first gear, said pinion gear having a rotational axis that is vertically displaced below a rotational axis of said first gear and below said gear rail; and a cross bar connected between said pinion gears and aligned with said rotational axis of said pinion gears such that driving force generated at one said gear assembly from an off-center pulling force on said lower pull-out drawer is transmitted through said cross bar to the opposite said gear assembly.

11. The refrigeration appliance as in claim 10, further comprising an icemaker disposed in said freezer compartment above said lower pull-out drawer, and an ice bucket disposed in a compartment area of said lower pull-out drawer to receive ice from said icemaker, said ice bucket having a depth within said lower pull-out drawer so as to extend above and rearward of said crossbar.

12. The refrigeration appliance as in claim 10, wherein said lower pull-out drawer comprises a front door panel, said slide brackets attached at opposite sides of said front door panel, and further comprising a slide assembly mounted to each opposite side of said compartment, said slide members moveable linearly into and out of said slide assemblies, said slide brackets attached to said slide members, said gear assemblies mounted to at least one of said slide member or said slide bracket.

13. The refrigeration appliance as in claim 12, wherein said gear assemblies are attached to said slide brackets with brackets and said first gears are attached to said slide member.

14. The refrigeration appliance as in claim 12, wherein said gear rails are configured with said slide assemblies.

15. The refrigeration appliance as in claim 10, wherein said gear assemblies comprises a vertically oriented connector housing, said first gear and said pinion gear rotationally carried in said connector housing, said connector housings attached to said slide brackets.

16. The refrigeration appliance as in claim 15, wherein said first gears are rotationally connected to said slide member.

17. The refrigeration appliance as in claim 10, wherein said pinion gears comprise a keyed hub, said cross bar having opposite ends that fit into said keyed hubs.

* * * * *